US008132385B2

(12) United States Patent
Phillips et al.

(10) Patent No.: US 8,132,385 B2
(45) Date of Patent: Mar. 13, 2012

(54) BENCHTOP PANELS

(75) Inventors: Paul D. Phillips, Frisco, TX (US); Michael A. McGregor, Lewisville, TX (US); Victor A. Sahm, Dallas, TX (US)

(73) Assignee: Southwest Agri-Plastic, Inc., Addison, TX (US)

( * ) Notice: Subject to any disclaimer, the term of this patent is extended or adjusted under 35 U.S.C. 154(b) by 850 days.

(21) Appl. No.: 11/034,684

(22) Filed: Jan. 13, 2005

(65) Prior Publication Data

US 2006/0162272 A1 Jul. 27, 2006

(51) Int. Cl.

| | |
|---|---|
| ***E04C 2/42*** | (2006.01) |
| ***E04C 5/04*** | (2006.01) |
| ***E04F 15/06*** | (2006.01) |
| ***E04F 19/00*** | (2006.01) |
| *A01G 9/00* | (2006.01) |
| *A01K 1/02* | (2006.01) |

(52) U.S. Cl. ..... 52/660; 47/18; 119/509; 119/529

(58) Field of Classification Search ..... 52/79.11–800.1; 119/525–530, 509, 450, 480, 445; 47/17, 47/18

See application file for complete search history.

(56) References Cited

U.S. PATENT DOCUMENTS

| | | | | | |
|---|---|---|---|---|---|
| 1,426,736 | A | * | 8/1922 | Hess | 52/667 |
| 2,127,270 | A | * | 8/1938 | Schaaf | 29/896.6 |
| 2,269,522 | A | * | 1/1942 | Dreibuss et al. | 52/660 |
| 2,394,713 | A | * | 2/1946 | Nagin | 52/581 |
| 2,407,059 | A | | 9/1946 | Crafton | |
| 2,607,455 | A | * | 8/1952 | Yellin | 52/664 |
| 2,689,366 | A | | 9/1954 | Wichert | |
| 2,770,336 | A | * | 11/1956 | Gingo et al. | 52/581 |
| 3,299,785 | A | * | 1/1967 | James | 404/4 |
| D225,417 | S | * | 12/1972 | Kitson | D30/116 |
| 3,777,432 | A | | 12/1973 | Wyles | |
| 3,846,945 | A | * | 11/1974 | Roby | 52/177 |
| 3,921,350 | A | | 11/1975 | Van Schoyck | |
| 3,964,221 | A | | 6/1976 | Berquist | |
| 4,226,064 | A | | 10/1980 | Kraayenhof | |
| 4,329,939 | A | | 5/1982 | Christie et al. | |
| 4,362,128 | A | | 12/1982 | Downey | |
| 4,468,910 | A | * | 9/1984 | Morrison | 52/591.2 |
| D282,105 | S | | 1/1986 | Moreau | |
| 4,727,697 | A | * | 3/1988 | Vaux | 52/177 |
| 4,785,604 | A | * | 11/1988 | Johnson, Jr. | 52/668 |
| 4,845,907 | A | | 7/1989 | Meek | |
| 4,897,299 | A | * | 1/1990 | Kawachi et al. | 428/131 |

(Continued)

OTHER PUBLICATIONS

Red Rooster Poultry Flooring Brochure, (3 pp.), date unknown, Double L Group Ltd., Monona, IA.

(Continued)

*Primary Examiner* — Eileen D Lillis
*Assistant Examiner* — Andrew Triggs
(74) *Attorney, Agent, or Firm* — Gardere Wynne Sewell, LLP

(57) ABSTRACT

Benchtop panels are formed with spaced apart longitudinal edge webs and intermediate webs and spaced apart transverse edge webs and intermediate webs forming a grid with parallel top and bottom surfaces. At least one pair of longitudinal and transverse intermediate webs are closely spaced to allow subdividing the panel into plural panels by severing portions of a panel at a point between the closely spaced webs. Longitudinal bottom surface flanges provide for ease of mounting panels on a frame or table at spaced apart frame members. A connector with spaced apart legs and a connecting tab may be inserted in openings formed in gussets of adjacent panels to secure panels to each other.

25 Claims, 6 Drawing Sheets

U.S. PATENT DOCUMENTS

| | | | | | |
|---|---|---|---|---|---|
| 4,909,660 | A | * | 3/1990 | Ferns | 404/2 |
| 4,913,579 | A | | 4/1990 | Campass | |
| 4,928,471 | A | * | 5/1990 | Bartley | 52/664 |
| 4,953,501 | A | * | 9/1990 | Moreau | 119/528 |
| D318,348 | S | | 7/1991 | Meek | |
| 5,058,355 | A | * | 10/1991 | Menchetti et al. | 52/489.1 |
| 5,138,807 | A | * | 8/1992 | Daw et al. | 52/177 |
| D332,509 | S | | 1/1993 | Kovatch | |
| D336,349 | S | | 6/1993 | Moreau | |
| D343,260 | S | | 1/1994 | Kovatch | |
| 5,364,204 | A | | 11/1994 | MacLeod | |
| 5,687,534 | A | * | 11/1997 | Kongsgaard et al. | 52/664 |
| 5,722,211 | A | * | 3/1998 | Goldschmidt | 52/665 |
| D397,457 | S | | 8/1998 | Hutchings | |
| 5,813,365 | A | * | 9/1998 | Helmy | 119/528 |
| 5,862,779 | A | * | 1/1999 | Kleinsasser | 119/529 |
| 5,882,764 | A | * | 3/1999 | Kessler et al. | 428/100 |
| 5,957,088 | A | * | 9/1999 | Knott et al. | 119/480 |
| 6,042,915 | A | * | 3/2000 | Kessler | 428/45 |
| 6,047,663 | A | * | 4/2000 | Moreau et al. | 119/529 |
| 6,068,908 | A | * | 5/2000 | Kessler et al. | 428/100 |
| 6,127,015 | A | * | 10/2000 | Kessler | 428/45 |
| 6,155,013 | A | * | 12/2000 | Kim | 52/263 |
| 6,260,321 | B1 | * | 7/2001 | Rudduck | 52/474 |
| 6,740,380 | B2 | * | 5/2004 | Kessler | 428/45 |
| 6,810,633 | B2 | * | 11/2004 | Harris, Sr. | 52/489.2 |
| 6,810,834 | B2 | * | 11/2004 | Hutchings et al. | 119/529 |
| 6,993,875 | B2 | * | 2/2006 | Rudduck | 52/474 |
| 7,066,111 | B2 | * | 6/2006 | McGregor | 119/509 |
| 7,287,356 | B2 | * | 10/2007 | Sacks et al. | 52/343 |

OTHER PUBLICATIONS

Waffle Grip Plastic Breeder Floor Slats Brochure, (1 p.), date unknown, W&M Plastics, Inc., Crawfordsville, IN.

* cited by examiner

BENCHTOP PANELS

BACKGROUND OF THE INVENTION

There are many applications for molded plastic structures, such as benchtop or tabletop panels, which require lightweight yet high strength structures and which structures should be provided in so-called standard dimensions. Benchtop panels are usually of rectangular configuration with lengths and widths in predetermined dimensional units, such as four feet by two feet, etc., but which also should be modifiable to be of reduced widths or lengths. There has also been a need to provide such panels which may be easily mounted on and connected to a frame or substructure. All of the above-mentioned desiderata are difficult to meet in prefabricated panels, particularly panels formed of injection molded plastics, or the like. However, the present invention does provide advantages and desired features in prefabricated benchtop panels as will be appreciated by those skilled in the art.

SUMMARY OF THE INVENTION

The present invention provides an improved benchtop panel which is lightweight, easily fabricated of molded plastic or the like, may be cut to various lengths and widths, is easy to mount on and connect to a frame or substructure and may be joined to adjacent panels by an improved connector system.

In accordance with an important aspect of the present invention, a benchtop panel is formed as a generally rectangular grid-like member having a predetermined length and width but which is fabricated to be cut in half lengthwise or widthwise to form separate panels or to reduce the overall length or width of a benchtop without sacrificing strength of the panel.

In accordance with another aspect of the invention, a benchtop panel is provided with spaced apart mounting flanges which are conveniently located for securing the panel to a frame or substructure by conventional mechanical fasteners, and particularly self-threading or self-tapping fasteners.

Still further, the present invention provides an improved benchtop panel which has requisite strength for typical benchtop panel applications while minimizing the amount of material required in the panel.

Still further, the present invention provides a benchtop panel assembly including two or more panels which are adapted to be connected to each other by an improved retainer or connector device for rapidly assembling two or more panels to form a benchtop.

Those skilled in the art will further appreciate the advantages and superior features of the invention, as mentioned herein, together with other important aspects thereof upon reading the detailed description which follows in conjunction with the drawings.

DETAILED DESCRIPTION OF A PREFERRED EMBODIMENT

Figures 1, 2:
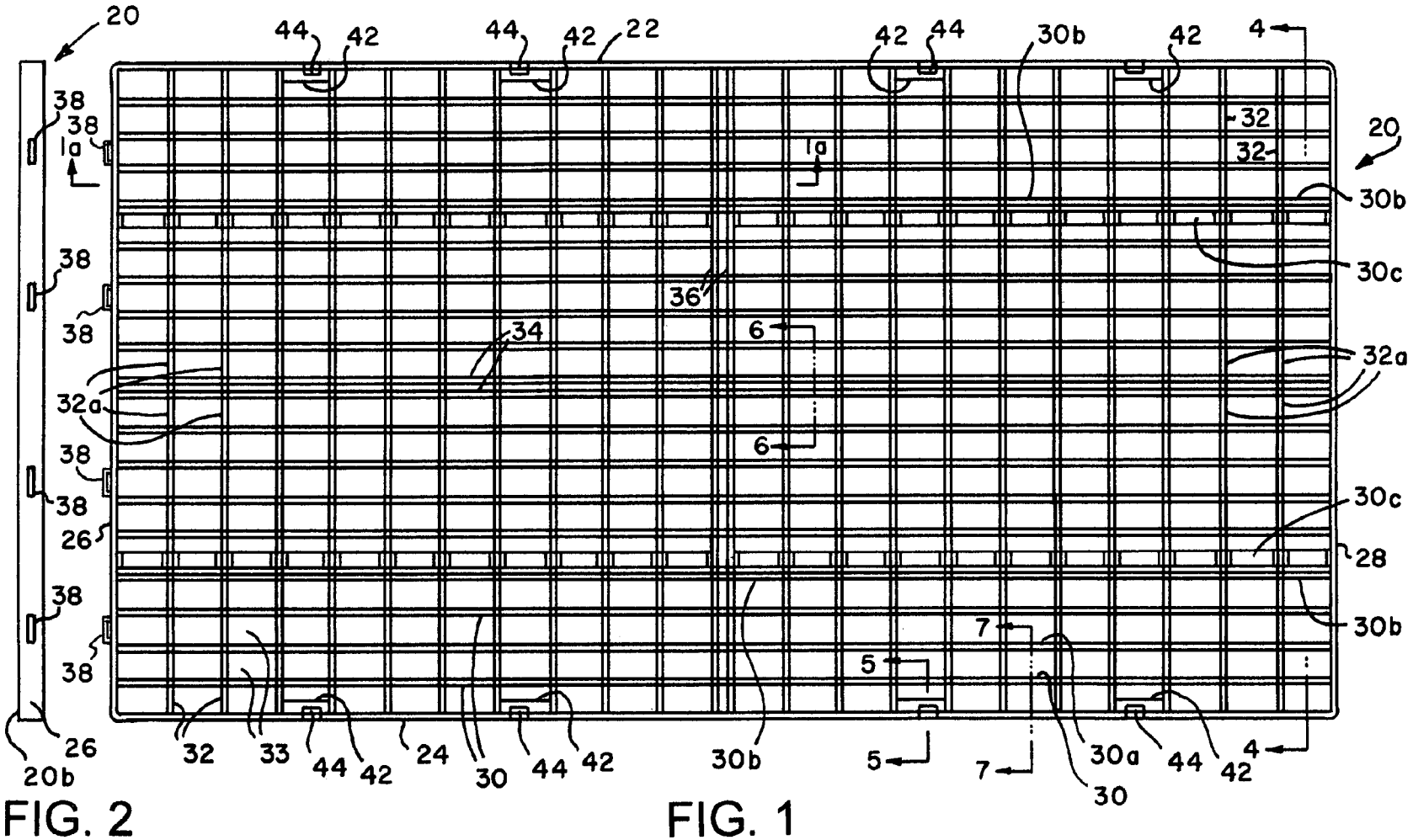
FIG. 1 is a top plan view of an improved benchtop panel in accordance with the present invention.
FIG. 2 is an end view of the panel shown in FIG. 1.

In the description which follows like parts are marked throughout the specification and drawing with the same reference numerals, respectively. The drawing figures are not necessarily to scale and certain elements may be shown exaggerated in scale or in generalized form in the interest of clarity and conciseness.

Figure 1A:
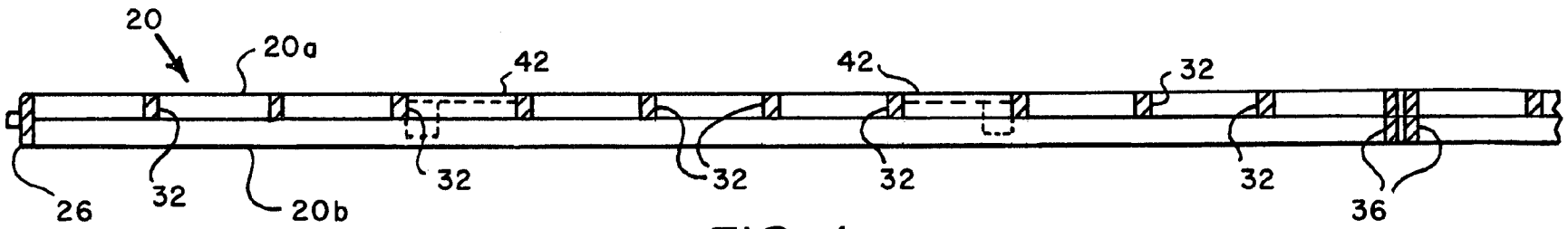
FIG. 1*a* is a detail section view taken generally along the line 1*a*-1*a* of FIG. 1.
Figure 4:
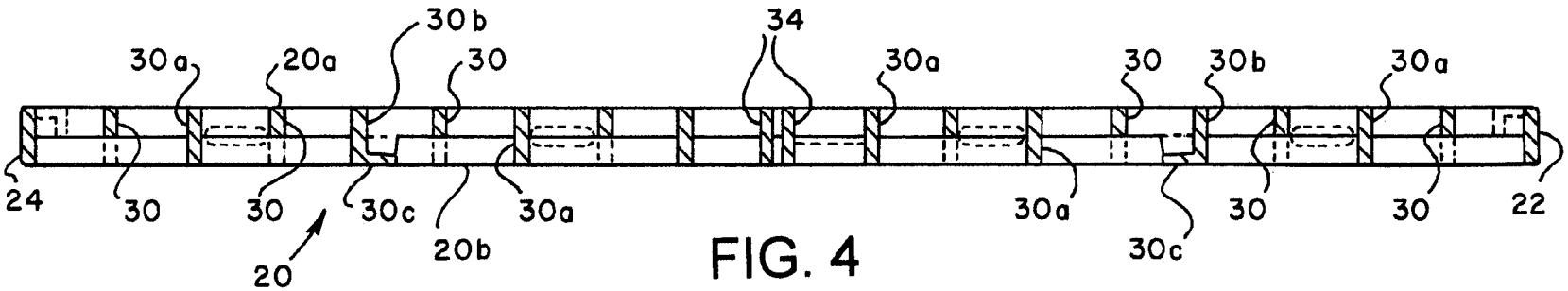
FIG. 4 is a section view taken along the line 4-4 of FIG. 1.

Referring to FIGS. 1, 1*a* and 4, in particular, there is illustrated a benchtop panel in accordance with the invention and generally designated by the numeral 20. The panel 20 is of generally rectangular configuration having spaced apart, elongated, outer, longitudinal, parallel edge webs 22 and 24 and transverse parallel end edge webs 26 and 28. Longitudinal intermediate webs 30 and 30*a* extend between the end webs 26 and 28 and transverse intermediate webs 32 extend between the longitudinal edge webs 22 and 24 to form a rectangular grid defining many rectangular openings 33. The grid defining the panel 20 is also provided with a pair of closely spaced longitudinal center webs 34 and a pair of centrally located transverse webs 36 which are also closely spaced adjacent each other. Webs 34 are parallel and substantially coextensive with webs 22, 24, 30 and 30*a* and webs 36 are coextensive with and parallel to webs 26, 28 and 32. As shown in FIG. 1*a*, end or edge web 26 and center webs 36 extend the full depth of panel 20 between top and bottom surfaces 20*a* and 20*b*. Intermediate webs 32, however, extend from surface 20*a* approximately one-half the full depth of the panel 20 between surfaces 20*a* and 20*b*. Edge web 28, not shown in FIG. 1*a*, also extends the full depth of the panel 20.

Referring to FIG. 4, it may be seen that longitudinal edge webs 22 and 24 extend the full depth of panel 20 between surfaces 20*a* and 20*b* while longitudinal webs 30 extend only about half the depth of panel 20 from surface 20*a*. However, webs 30*a*, which alternate with webs 30, extend the full depth of panel 20 as do the longitudinal center webs 34. Still further, panel 20 is provided with spaced apart longitudinal webs 30*b* which extend the full depth of panel 20 and are integrally joined to longitudinal flanges 30*c*, see FIGS. 1 and 4. Flanges 30*c* are substantially coplanar with surface 20*b* of panel 20, are disposed approximately equidistant from an edge web 22 or 24 and web 34 and are operable for securing the panel to a frame as will be described further herein.

Figure 3:
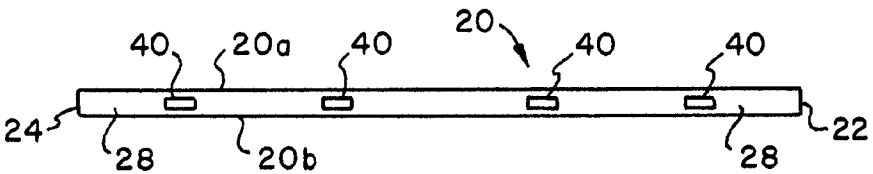
FIG. 3 is an opposite end view of the panel shown in FIG. 1.

Referring briefly to FIGS. 2 and 3, transverse end web 26 is formed integral with plural spaced apart projections or bosses 38, which are adapted to project into cooperating recesses in an adjacent panel. Such recesses are shown in FIG. 3 wherein transverse end or edge web 28 is provided with spaced apart recesses 40 which correspond in spacing to the spacing of the projections or bosses 38.

Figure 5:
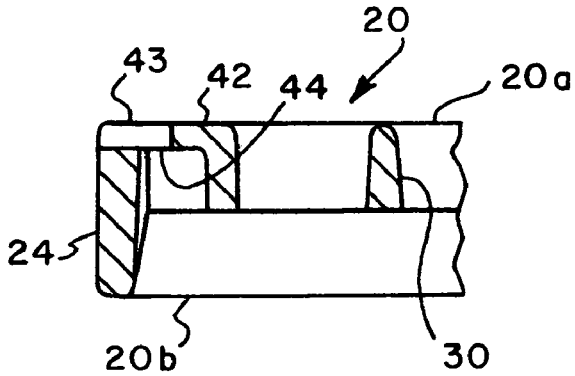
FIG. 5 is a detail section view taken along the line 5-5 of FIG. 1.

Panels 20 may be fabricated in different length and width dimensions and various thicknesses. Typically, panels 20 are advantageously fabricated in approximately two foot widths by four foot lengths, but may be modified as to length and width by cutting a panel 20 into two sections along a line between closely spaced webs 36, for example, or cutting a panel into two sections along a line between closely spaced webs 34 also. In this way, smaller or sub-panels may be formed as needed to satisfy the benchtop requirements of a panel application. Web thicknesses may vary, for example, between 0.125 inches to 0.151 inches. Also, for panels having the overall dimensions indicated above, a panel depth or thickness between surfaces 20*a* and 20*b* in the range of about 0.88 inches is also suitable. Spacings of webs 30 and 30*a* are typically about 1.14 inches and spacings of webs 32 are typically about 2.0 inches. Panel 20 is also provided with longitudinally spaced apart planar gussets 42, as shown in FIG. 1, extending along edge webs 22 and 24. Each of gussets 42 is provided with a recess 43, see FIG. 5, and an opening 44 therethrough for receiving a connector for connecting adjacent panels 20 to each other as will be described further herein.

Figure 6:
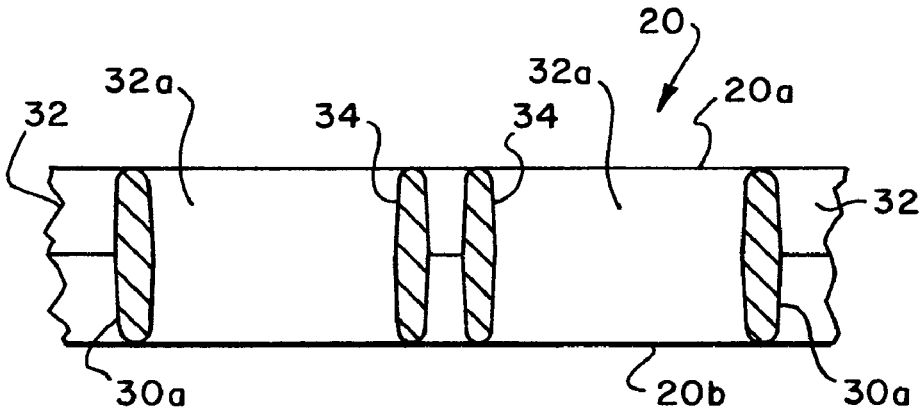
FIG. 6 is a detail section view taken along the line 6-6 of FIG. 1.
Figure 7:
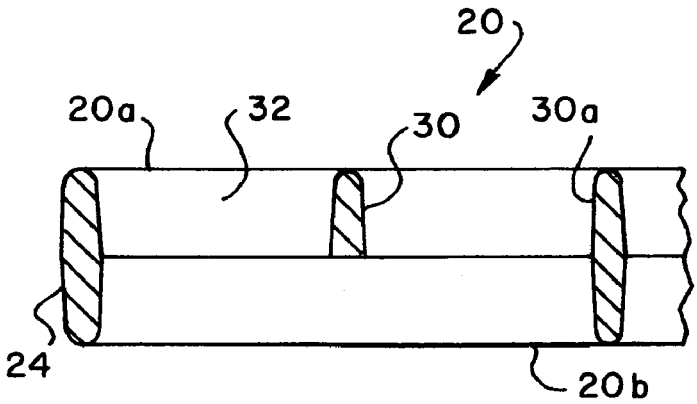
FIG. 7 is a detail section view taken along the line 7-7 of FIG. 1.

Referring briefly to FIG. 6, the region of the panel 20 which includes the closely spaced webs 34 and adjacent full depth webs 30*a* is also reinforced by transverse webs 32*a* which are full depth between webs 30*a* and webs 34, as indicated. Webs 32*a* are coplanar with respective webs 32 throughout the length of the panel 20, see FIG. 1. In this way, if a panel 20 is separated into two elongated panel sections by cutting the panel to sever all of the webs 32*a* between closely spaced adjacent webs 34, the panel will still be of requisite strength after being split into separate sections.

Figure 8:
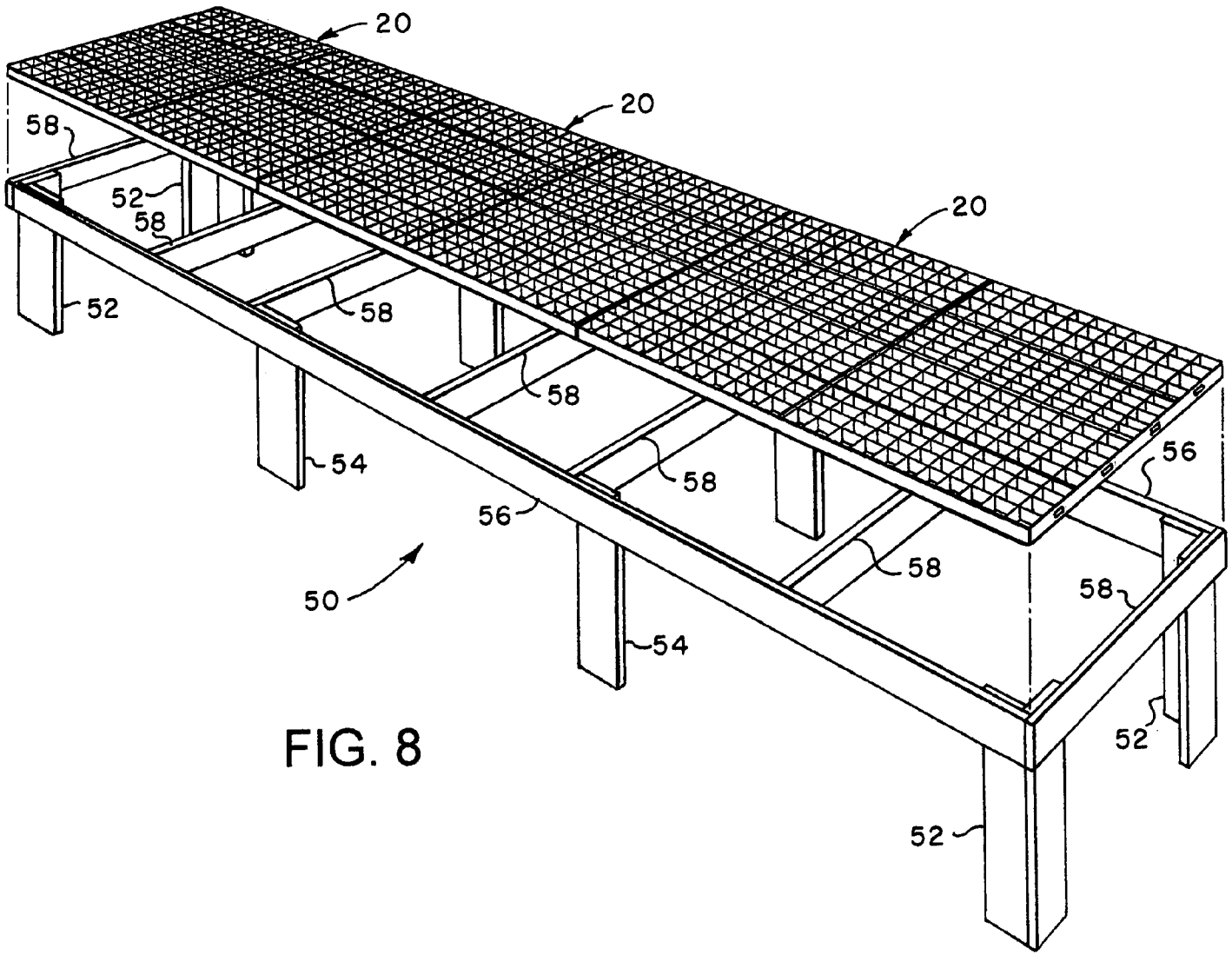
FIG. 8 is a perspective view showing one arrangement of panels in accordance with the invention as a benchtop.

One important advantage of panel 20 in accordance with the invention is with respect to the ease of mounting multiple panels on and securing such panels to a table, bench or frame, as shown in FIG. 8. Referring to FIG. 8, a table or frame 50, as illustrated, is characterized by spaced apart legs 52 and 54 supporting longitudinal frame members 56 and transverse frame members 58. Transverse frame members 58, are preferably spaced apart equidistant from each other but may be spaced as desired, because placing panels 20 on top of frame 50 will allow for securing the panels to the frame members 58, since flanges 30*c* extend the entire length of each panel and will directly overlie frame members 58. In this way, conventional mechanical fasteners may be driven through flanges 30*c* at the points of contact with the frame members 58 to properly secure the panels 20 to a frame, such as the frame 50. The exemplary frame 50 illustrated in FIG. 8 may be formed of metal or wood. Wood frame members 52, 54, 56 and 58 are illustrated.

Figure 9:
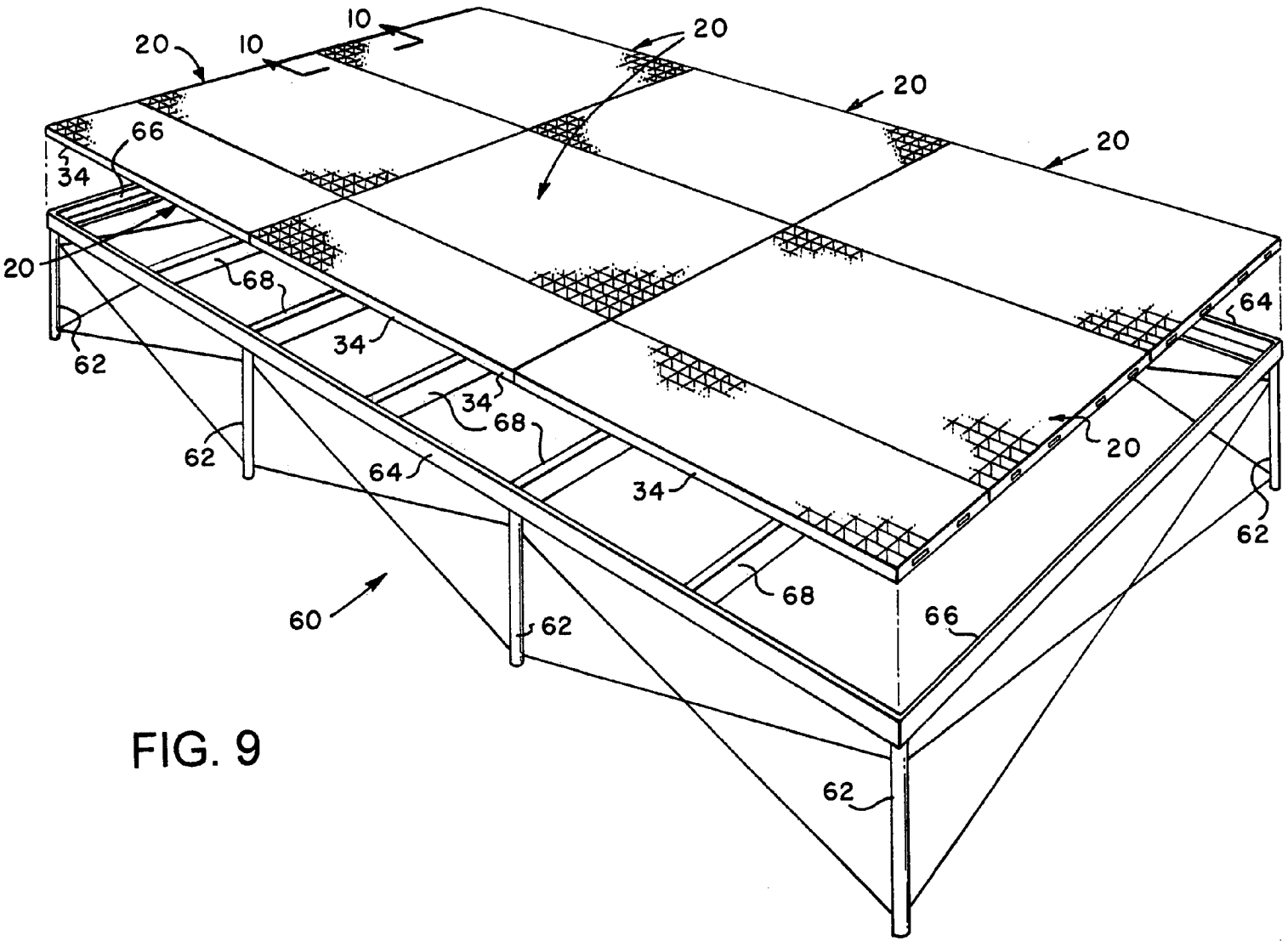
FIG. 9 is a perspective view showing a different arrangement of panels in accordance with the invention as a benchtop.
Figure 13:
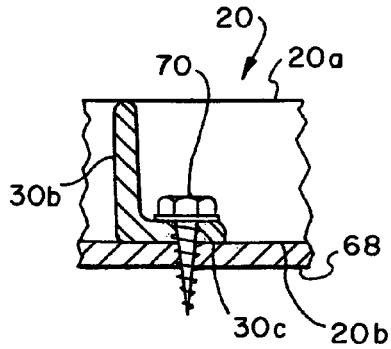
FIG. 13 is a detail section view illustrating a typical connection between a panel and a frame member in accordance with the invention.

Referring also to FIG. 9, another embodiment of a table or frame 60 is illustrated for supporting plural side by side panels 20, as shown. Table or frame 60 is characterized by vertical leg members 62, longitudinal and transverse perimeter members 64 and 66 and intermediate transverse frame members 68. Frame members 64, 66 and 68 may be formed of metal angle mill shape members arranged as shown. Again, by constructing a simple table or frame, such as the frame 60, with spaced apart transverse frame members 68, panels 20 may be placed on top of the frame members 68 and secured thereto at the flanges 30*c* with suitable mechanical fasteners. FIG. 13 illustrates a typical connection between a flange 30*c* and a frame member 68, for example. In FIG. 13, flange 30*c* is secured to a frame member 68 by a conventional self tapping hexhead screw 70 of a type which may be conveniently and rapidly driven through the thermoplastic flange 30*c* and into or through the metal or wood frame member 68, as shown by way of example. Accordingly, the panels 20 may be quickly and easily secured to a table or frame, such as the tables or frames 50 and 60, by placing the panels on the frames and conveniently driving mechanical fasteners, such as screws 70 through the flanges 30*c* at the points of contact with the respective frame members 58 or 68. As shown in FIG. 9, one row of panels 20 has been cut along a line between webs 34 to form a row of panels of one half the width of the other two rows of panels.

Figure 10:
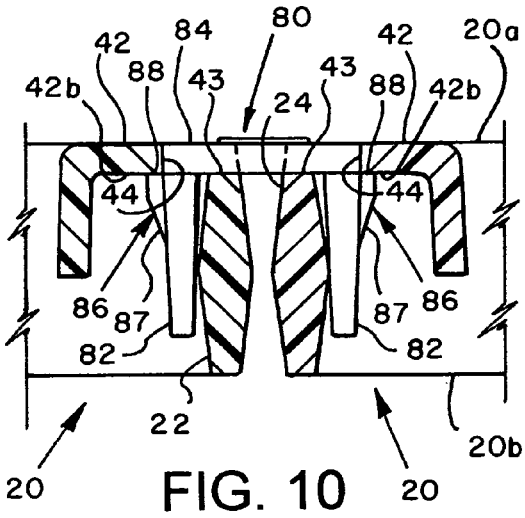
FIG. 10 is a detail section view taken along the line 10-10 of FIG. 9.
Figure 11:
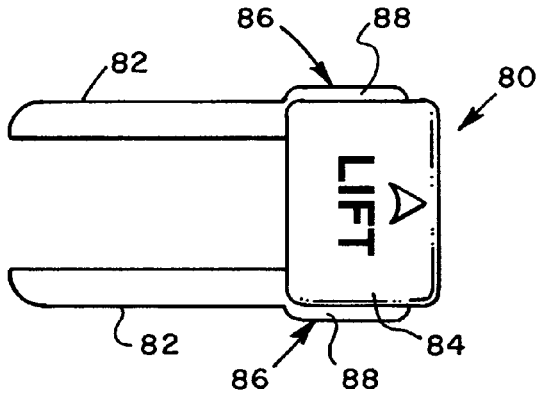
FIG. 11 is a top plan view of a connector for connecting adjacent panels to each other as shown in FIG. 10.
Figure 12:
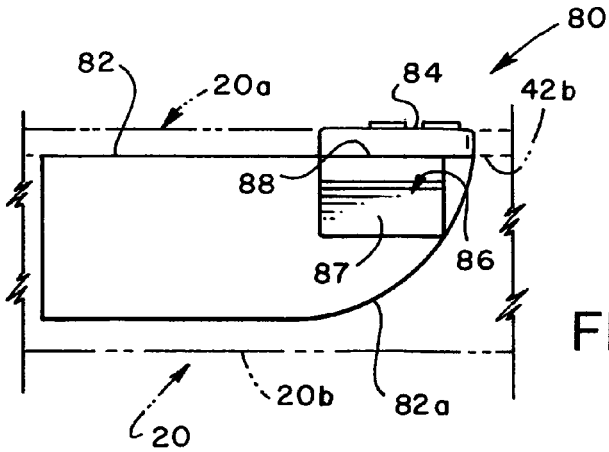
FIG. 12 is a side elevation of the connector shown in FIGS. 10 and 11.

In addition to the advantageous features of the support or connecting flanges 30*c* formed on each panel 20, adjacent panels 20 may be connected to each other with an improved connector, as illustrated in FIGS. 10 through 12. Referring to FIGS. 10 through 12, a panel connector 80 is illustrated comprising two spaced apart parallel legs 82 which include adjacent arcuate ends 82*a*, see FIG. 12, and are interconnected by an integral tab 84. Legs 82 are each provided with aligned and opposed projections 86 which have a tapered sidewall 87. Projections 86 include a panel engaging surface 88. When two panels 20 are placed adjacent each other and aligned at their transverse ends, respective gussets 42 on each panel are also aligned with gussets 42 on an adjacent panel. Adjacent panels 20 may be connected to each other by projecting the legs 82 of a connector 80 through the adjacent openings 44 in adjacent gussets 42 and rotating the connector into the position shown in FIGS. 10 and 12 so that connecting tab 84 resides in adjacent recesses 43 formed in the respective gussets 42. The connectors 80 may be snapped into place by slightly deflecting the gussets 42 as well as the connector legs 82 until the retainer surfaces 88 of the respective bosses move through the opening 44 and engage downwardly facing surfaces 42*b* of the gussets 42 as illustrated in FIG. 10.

With suitable force exerted thereon, the tabs 84 may also be lifted to remove connectors 80 from their working positions, if needed. Accordingly, adjacent panels 20 may be also quickly and conveniently joined to each other by placing connectors 80 in the openings 44 of adjacent panels, and rotating the connectors into the working position, as shown in FIGS. 10 and 12, to aid in securing the panels to each other to maintain a rigid support surface, such as the upper surface 20*a*. The spacings of openings 44 and recesses 43 on adjacent gussets 42 may be varied, as shown in FIG. 1, so that adjacent ones of connectors 80 face in opposite directions.

The construction and use of the benchtop panel 20 described herein, as well as the use of plural panels connected to each other by the connectors 80 and mounted on tables or frames, such as described, is believed to be understandable to those of ordinary skill in the art based on the foregoing description. Any number of panels 20 may be used to make up a benchtop support surface, depending only on the constraints of the space allocated for the underlying frame or table structure and by the dimensional intervals between the side edges of a panel and the closely spaced webs 34 and 36 which allow a panel to be subdivided in several ways.

Although a preferred embodiment of the invention has been described in detail herein, those skilled in the art will recognize that various substitutions and modifications may be made without departing from the scope and spirit of the appended claims.

What is claimed is:

1. A substantially rectangular, planar benchtop panel configured for interconnection with another benchtop panel, each panel comprising:

a top surface and an opposed bottom surface;

longitudinal spaced apart edge webs;

transverse spaced apart edge webs intersecting said longitudinal spaced apart edge webs, said longitudinal and transverse spaced apart edge webs defining the boundaries of said panel;

longitudinal spaced apart intermediate webs disposed between said longitudinal spaced apart edge webs and extending between and connecting said transverse edge webs; and transverse spaced apart intermediate webs intersecting said longitudinal spaced apart intermediate webs, the transverse intermediate webs disposed between the transverse edge webs and extending between and connecting said longitudinal edge webs;

wherein a pair of longitudinal intermediate webs extend between said top and bottom surfaces and a pair of transverse intermediate webs extend between said top and bottom surfaces and are spaced more closely adjacent each other than other longitudinal and transverse intermediate webs, said other longitudinal and transverse intermediate webs extending from said top surface to the bottom surface but not all the way to the bottom surface, each one of said pair of adjacent longitudinal intermediate webs serving as longitudinal edge webs when separating a panel into plural sections by cutting the panel between the pair of adjacent longitudinal intermediate webs, and each one of said pair of adjacent transverse intermediate webs serving as transverse edge webs when separating a panel into plural sections by cutting the panel between the pair of adjacent transverse intermediate webs.

2. The panel set forth in claim 1 including:

longitudinal webs disposed between said longitudinal intermediate webs and said longitudinal edge webs and extending between said transverse edge webs.

3. The panel set forth in claim 2 wherein:

alternate ones of said longitudinal, webs are less than the full depth of said panel between said top surface and said bottom surface.

4. The panel set forth in claim 3 including:

spaced apart transverse webs extending parallel to and disposed between said transverse edge webs and said closely spaced transverse intermediate webs.

5. The panel set forth in claim 4 wherein:

selected ones of said transverse webs have a depth less than the depth of said panel between said surfaces.

6. The panel set forth in claim 1 wherein:

one of said transverse edge webs includes spaced apart bosses projecting therefrom and adapted to be fitted in cooperating recesses formed in a transverse edge web of an adjacent panel.

7. The panel set forth in claim 6 wherein:

one of said transverse edge webs is provided with spaced apart recesses formed therein for receiving bosses projecting from an edge web of an adjacent panel.

8. The panel set forth in claim 1 including:

spaced apart gussets extending along opposite longitudinal edge webs, said gussets each including an opening formed therein for receiving a connector for connecting adjacent panels to each other.

9. The panel set forth in claim 8 including:

a connector for connecting adjacent panels to each at adjacent ones of said gussets, said connector including parallel spaced apart legs interconnected substantially at one end of said legs, respectively, said legs being insertable in openings formed in said gussets of adjacent panels for securing adjacent panels to each other.

10. The panel set forth in claim 9 wherein:

said connector includes a transverse tab connected to said legs, respectively, at one end thereof and operable for inserting said connector into said openings and for removing said connector from said openings, respectively.

11. The panel set forth in claim 10 wherein:

said connector includes opposed projections engageable with gussets on adjacent panels for retaining said connector in a position to secure said adjacent panels to each other.

12. The panel set forth in claim 1 including:

at least two spaced apart longitudinal and substantially parallel flanges on said panel extending between said transverse edge webs and substantially coplanar with said bottom surface of said panel, said flanges being operable to receive fasteners for securing said panel to a frame.

13. A substantially rectangular, planar benchtop panel configured for interconnection with another benchtop panel, each panel comprising:

a top surface and an opposed bottom surface;

longitudinal spaced apart edge webs;

transverse spaced apart edge webs intersecting the longitudinal spaced apart edge webs, said longitudinal and transverse spaced apart edge webs defining the boundaries of said panel;

longitudinal spaced apart intermediate webs disposed between and spaced apart from longitudinal spaced apart edge webs and extending between and connecting said transverse spaced apart edge webs; and transverse spaced apart intermediate webs intersecting the longitudinal spaced apart intermediate webs, the transverse intermediate webs disposed between and spaced apart from the transverse edge webs and extending between and connecting said longitudinal spaced apart edge webs;

wherein a pair of longitudinal intermediate webs extend between said top and bottom surfaces and a pair of transverse intermediate webs extend between said top and bottom surfaces and are spaced more closely adjacent each other than other longitudinal and transverse intermediate webs, said other longitudinal and transverse intermediate webs extending from said top to said bottom surface but not all the way to the bottom surface, each one of said pair of adjacent longitudinal intermediate webs serving as longitudinal edge webs when separating a panel into plural sections by cutting said panel between the pair of adjacent longitudinal intermediate webs, and wherein at least two spaced apart longitudinal intermediate webs extending between said top and opposed bottom surfaces each have a flange extending therefrom and substantially coplanar with said bottom surface of said panel, said flanges being within the boundaries of said panel and each flange being operable to receive fasteners for securing said panel to a frame.

14. The panel set forth in claim 13 further including:

a pair of transverse intermediate webs spaced more closely adjacent each other than said other transverse intermediate webs to serve as edge webs when separating a panel into plural sections by severing said panel between said adjacent transverse intermediate webs.

15. The panel set forth in claim 13 wherein:

alternate ones of said longitudinal intermediate webs are less than the full depth of said panel between said top surface and said bottom surface.

16. The panel set forth in claim 13 wherein:

selected ones of said transverse intermediate webs have a depth less than the depth of said panel between said surfaces.

17. The panel set forth in claim 13 wherein:

one of said transverse edge webs includes spaced apart bosses projecting therefrom and adapted to be fitted in cooperating recesses formed in a transverse edge web of an adjacent panel.

18. The panel set forth in claim 17 wherein:

one of said transverse edge webs is provided with spaced apart recesses formed therein for receiving bosses projecting from an edge web of an adjacent panel.

19. The panel set forth in claim 13 including:

spaced apart gussets extending along opposite longitudinal edge webs, said gussets each including an opening formed therein for receiving a connector for connecting adjacent panels to each other.

20. The panel set forth in claim 19 including:

a connector for connecting adjacent panels to each at adjacent ones of said gussets, said connector including parallel spaced apart legs interconnected substantially at one end of said legs, respectively, said legs being insertable in openings formed in said gussets of adjacent panels for securing adjacent panels to each other and said connector includes a transverse tab for inserting said connector into said openings and for removing said connector from said openings.

21. The panel set forth in claim 20 wherein:

said connector includes opposed projections engageable with gussets on adjacent panels for retaining said connector in a position to secure said adjacent panels to each other.

22. A substantially rectangular, planar benchtop panel comprising:

a top surface and an opposed bottom surface;

longitudinal spaced apart edge webs and transverse spaced apart edge webs defining the boundaries of said panel;

respective longitudinal intermediate webs and transverse intermediate webs forming a grid;

spaced apart gussets at opposite longitudinal edge webs, said gussets each disposed at least partially between a longitudinal edge web, a longitudinal intermediate web, and a pair of transverse intermediate webs, each gusset including an opening, the opening being adjacent a recess defined by the top surface of the longitudinal edge web, the opening and the recess formed for receiving a portion of a connector for connecting adjacent panels to each other; and a connector for connecting adjacent panels to each other at adjacent ones of said gussets, said connector including parallel spaced apart legs interconnected substantially at one end of said legs, respectively, by a transverse tab, said legs each including a projection having a panel engaging surface, wherein one of said legs of said connector is insertable into an opening formed in said gusset of one panel and wherein the other one of said legs of said connector is insertable into an opening formed in said gusset of an adjacent panel and wherein said transverse tab is disposed within the recess formed on the longitudinal edge webs of said respective panels such that said respective panel engaging surfaces engage a downwardly facing surface of said gussets of each respective panel for securing adjacent panels to each other.

23. The panel set forth in claim 22 wherein:

said transverse tab is operable for inserting said connector into said openings and for removing said connector from said openings, respectively.

24. A substantially rectangular, planar support panel comprising:

a top surface and an opposed bottom surface;

longitudinal spaced apart edge webs and transverse spaced apart edge webs defining the boundaries of the panel;

respective longitudinal intermediate webs and transverse intermediate webs forming a grid;

spaced apart gussets at opposite longitudinal edge webs, the gussets each disposed at least partially between a longitudinal edge web, a longitudinal intermediate web, and a pair of transverse intermediate webs, each gusset including an opening, the opening being adjacent a recess defined by the top surface of the longitudinal edge web to receive a connector for connecting adjacent panels to each other; and the connector including parallel spaced apart legs connective by a transverse tab, the legs each including a projection having a panel engaging surface, wherein one of the legs is insertable into an opening formed in the gusset of one panel and wherein the other one of the legs is insertable into an opening formed in the gusset of an adjacent panel, wherein the transverse tab is disposed within the recess of the respective panels and the respective panel engaging surfaces engage a downwardly facing surface of the gussets of each respective panel for securing adjacent panels to each other.

25. The support panel of claim 24, wherein an upper surface of the transverse tab is substantially coplanar with the top surface of the panel.

* * * * *